US008561248B2

(12) United States Patent
Fatiny

(10) Patent No.: US 8,561,248 B2
(45) Date of Patent: Oct. 22, 2013

(54) FLEXIBLE, ERGONOMIC TOOTHBRUSH WITH REPLACEABLE BRISTLES

(75) Inventor: Fahad Ibrahim Fatiny, Riyadh (SA)

(73) Assignee: King Saud University, Riyadh (SA)

( * ) Notice: Subject to any disclaimer, the term of this patent is extended or adjusted under 35 U.S.C. 154(b) by 231 days.

(21) Appl. No.: 13/218,391

(22) Filed: Aug. 25, 2011

(65) Prior Publication Data

US 2013/0047364 A1 Feb. 28, 2013

(51) Int. Cl.
*A47L 9/04* (2006.01)

(52) U.S. Cl.
USPC ..... 15/167.1; 15/172; 15/201

(58) Field of Classification Search
USPC ..... 15/167.1, 22.1, 22.2, 201, 172
See application file for complete search history.

(56) References Cited

U.S. PATENT DOCUMENTS

| | | | | |
|---|---|---|---|---|
| 2,262,892 | A | 11/1941 | Heard | |
| 2,431,861 | A * | 12/1947 | Babe | 15/167.1 |
| 3,624,667 | A * | 11/1971 | Muhler | 15/167.1 |
| 4,010,509 | A | 3/1977 | Huish | |
| D258,999 | S | 4/1981 | Eglar | |
| 4,672,177 | A | 6/1987 | Headrick | |
| 4,672,706 | A | 6/1987 | Hill | |
| 4,706,322 | A | 11/1987 | Nicolas | |
| 5,247,718 | A | 9/1993 | Victorian | |
| 5,511,276 | A | 4/1996 | Lee | |
| D378,711 | S | 4/1997 | Occhetti | |
| 5,753,012 | A | 5/1998 | Firnhaber et al. | |
| 6,079,075 | A * | 6/2000 | Velez-Juan | 15/167.1 |
| 6,374,448 | B2 | 4/2002 | Seifert | |
| 6,401,291 | B1 | 6/2002 | Lee | |
| D462,175 | S | 9/2002 | Harada | |
| 6,513,182 | B1 | 2/2003 | Calabrese et al. | |
| 6,988,292 | B1 | 1/2006 | Wang et al. | |
| 7,574,765 | B2 | 8/2009 | Huber et al. | |
| 8,359,697 | B2 * | 1/2013 | Wang | 15/167.1 |
| 2002/0124333 | A1 | 9/2002 | Hafliger et al. | |
| 2003/0208865 | A1 | 11/2003 | Davies | |
| 2003/0208870 | A1 | 11/2003 | Jimenez | |
| 2004/0025275 | A1 | 2/2004 | Moskovich et al. | |
| 2009/0188063 | A1 | 7/2009 | Baertschi et al. | |

FOREIGN PATENT DOCUMENTS

| | | |
|---|---|---|
| WO | WO 97/35498 | 10/1997 |

OTHER PUBLICATIONS

Colgate Wave Toothbrush, www.Colgate.com/app/Colgate/US/OC/Products/Toothbrushes/ColgateWaveToothbrush.cvsp 2011 one page.

* cited by examiner

*Primary Examiner* — Shay Karls
(74) *Attorney, Agent, or Firm* — Richard C. Litman

(57) ABSTRACT

The flexible, ergonomic toothbrush with replaceable bristles has a handle, a bristle block having bristles extending therefrom, and a brush head frame configured to removably receive the bristle block. The brush head frame has a pair of parallel prongs that define a recess and that slidably engage opposite sides of the bristle block so that the bristle block can be selectively disposed in first and second operative positions in the recess, the bristles extending in opposite directions in the operative positions. A neck interconnects the handle and the brush head frame, the neck being flexible relative to the handle.

10 Claims, 2 Drawing Sheets

FLEXIBLE, ERGONOMIC TOOTHBRUSH WITH REPLACEABLE BRISTLES

BACKGROUND OF THE INVENTION

1. Field of the Invention

The present invention relates to toothbrushes, and more particularly to a flexible, ergonomic toothbrush with replaceable bristles that is configured to reduce stress and strain on the user, and which features a replaceable bristle block that is supported on a flexible brush handle arrangement.

2. Description of the Related Art

A number of different brushing techniques have evolved with the passing of time. These include, by way of example, the Bass method, the Charter method and the Modified Stillman method. The Bass method is useful for all types of dental conditions, especially periodontal problems. With bristles pointed at a 45° angle into the gingival sulcus, the user vibrates the brush gently back and forth a plurality of times and then moves the brush forward, whereafter the process is repeated.

The Charter's Method is useful for patients with severe loss of interdental papilla height, fixed prosthetic appliances, previous gingival surgery, or subsided ulcerative gingivitis. The method includes a first rolling stroke to remove debris from the teeth. Then, the bristle tips are directed toward the occlusal or incisal surfaces of the user's teeth. Next, the handle of the brush is gently rotated, thus flexing the bristles and bringing them into contact with the interdental tissues and exposed proximal surfaces. The brush handle is then vibrated with a slow, circular motion.

The Modified Stillman's Method is useful for patients with hypersensitive gingiva or slightly reduced interdental papilla. This technique uses the rolling stroke method while vibrating the bristles in a lateral motion. The rolling stroke method involves placing the brush above the free gingiva with the bristles pointed toward the apices. Then, by exerting a light pressure, the user draws the brush toward the occlusal surface using a rolling stroke.

Nevertheless, these methods and other common tooth brushing techniques and the associated difficulty involved with vigorous tooth brushing often lead to physical fatigue. This fatigue usually develops in the dorsal group of the shoulder muscles due to their relatively important role in controlling the scrub techniques, and due to the way that the hand grasps the brush. Various devices, such as contoured and shaped handles, have been proposed, but such devices have not met with anything more than partial success.

Thus, a flexible, ergonomic toothbrush with replaceable bristles solving the aforementioned problems is desired.

SUMMARY OF THE INVENTION

The flexible, ergonomic toothbrush with replaceable bristles is directed to reducing user fatigue when brushing and reducing the risk of tooth brushing trauma by providing a toothbrush that can reach distant tooth surfaces easily and that can be used by the handicapped, particularly handicapped children. The flexible, ergonomic toothbrush with replaceable bristles has a handle, a bristle block having bristles extending therefrom, and a brush head frame configured to removably receive the bristle block. The brush head frame has a yoke or pair of parallel prongs that define an open-ended recess. The prongs slidably engage opposite sides of the bristle block so that the bristle block can alternately be disposed in first and second operative positions in the open-ended recess, the operative positions facing 180° apart. The handle and the brush head frame are connected by an arcuate, flexible neck that includes a 90° bend so that the bristle block extends orthogonal to the handle, the bristles also extending laterally when facing the front face of the handle.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The flexible, ergonomic toothbrush with replaceable bristles is depicted in FIGS. 1-4. As will be appreciated, the brush has a handle 10, a neck 12, and a brush head frame 14. The neck 12 is curved and reduced in diameter with respect to the major portion of the handle 10 so that the neck has a predetermined amount of flexibility and may flex with respect to the handle 10. The neck 12 has a 90° bend so that the prongs of the brush head frame 14, and hence the bristle block 16, extend orthogonal to the handle 10, the front face of the handle facing upward in the side view of FIG. 1, i.e., the handle may be flat.

Figure 1:
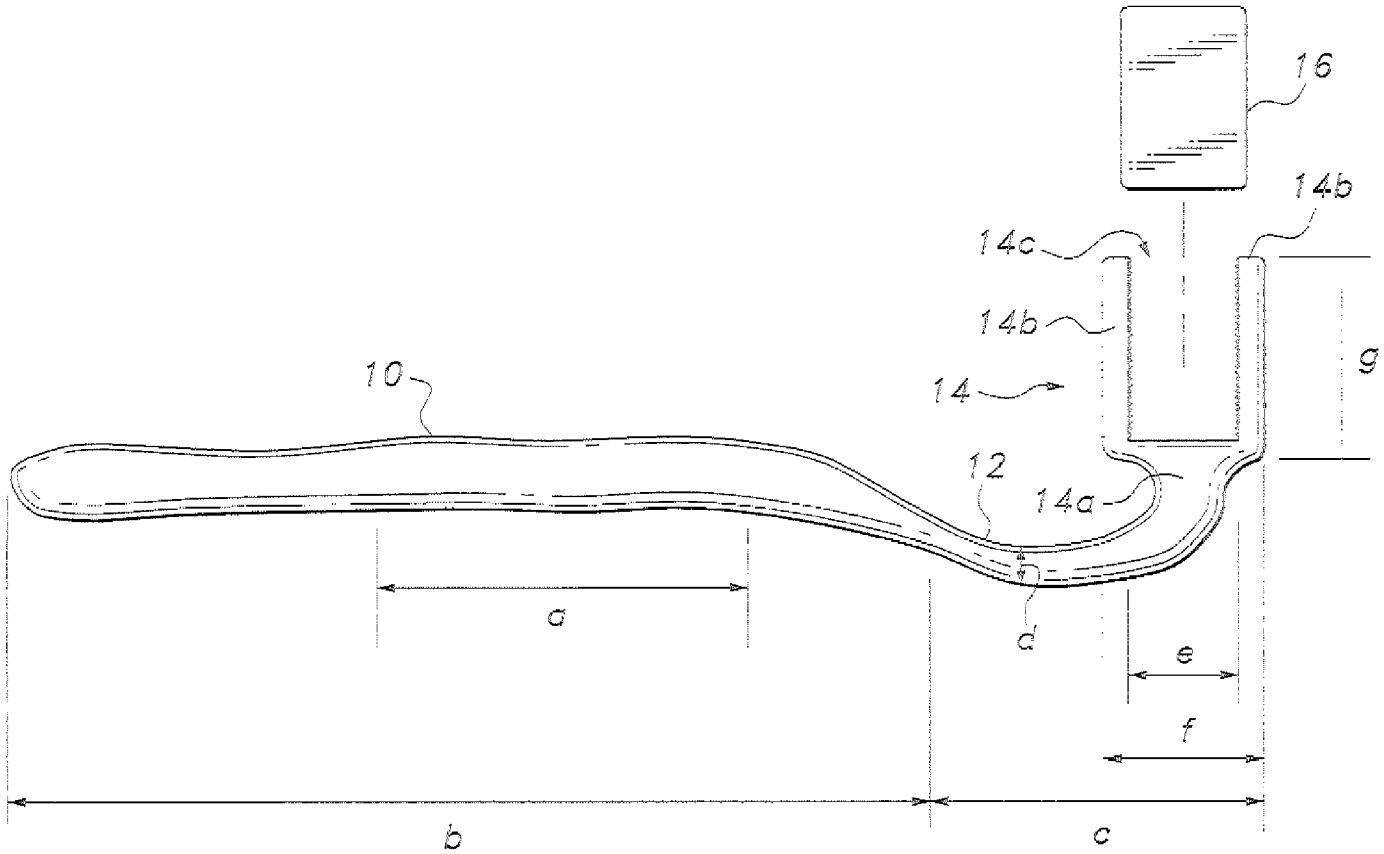
FIG. 1 is a side elevational view of a flexible, ergonomic toothbrush with replaceable bristles according to the present invention, the brush block being exploded therefrom.
Figure 4:
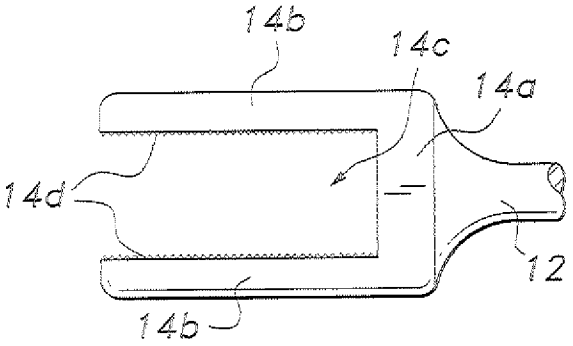
FIG. 4 is a partial side view of the flexible, ergonomic toothbrush of FIG. 1, showing an enlarged detail view of the brush head frame.
Figure 3:
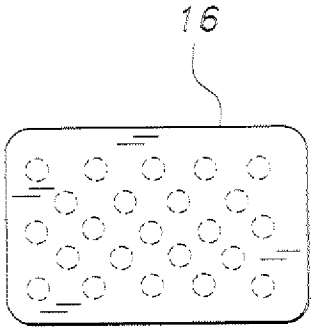
FIG. 3 is a plan view of the side of the bristle block of FIG. 2 opposite the bristles.
Figure 2:
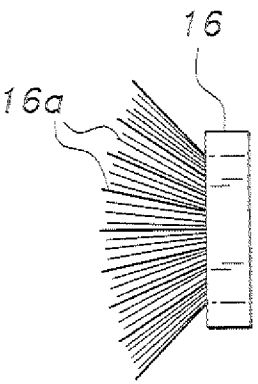
FIG. 2 is an end view of a bristle block for the flexible, ergonomic toothbrush of FIG. 1.

The brush head frame 14 is configured to slidably receive and hold a bristle block 16 in a first position wherein the bristles extend in a first direction (into the page in FIG. 1), and in a second reversed position wherein the bristles extend in a second direction that is opposite to the first direction (out of the page in FIG. 1). This reversibility facilitates orienting the bristles as needed, e.g., by first orienting the bristles for brushing the buccal (cheek) sides of a user's teeth (i.e., into the page in FIG. 1), and then removing the bristle block 16 and reinserting the block 16 in the frame 14 with the bristles facing 180° opposite for brushing the lingual (tongue) sides of a user's teeth (i.e., out of the page in FIG. 1).

The brush head frame 14 comprises an end portion 14*a* joining the neck 12 and two parallel or substantially parallel prongs or tines 14*b*, which are arranged to engage the sides of the bristle block 16. The prongs 14*b* and the end portion 14*a* define a substantially U-shaped recess 14*c* that receives the bristle block 16. In order to grip the bristle block 16, the prongs 14*b* can be arranged to extend inwardly toward one another by a limited amount when the block 16 is not disposed therebetween, and the prongs 14*b* may resiliently grip the bristle block 16, or the block 16 may form a friction fit or pressure fit with the prongs 14*b*, or the block 16 may be positively locked in the recess 14*c* in any other manner so that the block 16 does not become dislodged during brushing.

In order to retain the bristle block 16 in an operative position, the inboard or inwardly extending edges of the prongs 14*b* can be formed with teeth, ribs, or other engagement members 14*d* that increase frictional engagement with the bristle block 16 so that the bristle block 16 remains in position in the brush head frame 14 throughout a brushing operation or operations and/or as long as it is desired. The engagement members 14*d* can take the form of crenulations, serpentine configurations, or they can have a saw-tooth profile, knurled surfaces, or the like. If desired, the sides of the bristle block 16 can be formed with corresponding members configured to mate with or otherwise engage with those formed on the inboard faces of the prongs 14*b*.

The bristle block 16 may be provided with two different types of bristles 16*a* that extend from an elongated, planar base. The first type is formed of a first relatively hard material, while the other type is formed of a relatively flexible material. The hard bristles, of course, are intended to provide a first well-known cleaning/brushing action, while the flexible bristles are intended to provide a second different and equally well-known cleaning/brushing function.

The toothbrush may have any desired dimensions. By way of example, and not by way of limitation, the toothbrush of FIG. 1 may have the following exemplary dimensions. The handle 10 is configured so that the dimension "a" of the upper end of the grip portion of the handle 10 is 50 mm, the length "b" of the handle 10 is 120 mm, the distance "c" from the handle 10 to the end of the brush head frame 14 is 55 mm, and the diameter "d" of the neck 12 is 0.5 mm. Further, the width "f" (outside dimension) of the brush head frame 14 is 16 mm, while the width "e" of the recess 14*c* is 14 mm. The width of the bristle block 16 is also about 14 mm, while the width or thickness of each of the prongs 14*b* is about 1 mm.

It is to be understood that these dimensions are merely exemplary and that they are in no way limiting on the variations that may be implemented.

The selection of the material or materials from which the handle 10, neck 12 and brush head frame 14 are composed, along with the materials from which the bristles 16*a* and bristle block 16 are formed, are conventional and well within the purview of a person of ordinary skill in the art. Additionally, the use of a mixture of materials (and/or dimensions) and the formation of different components from these different materials is within the purview of a person of ordinary skill in the art.

It is to be understood that the present invention is not limited to the embodiments described above, but encompasses any and all embodiments within the scope of the following claims.

I claim:

1. A flexible, ergonomic toothbrush with replaceable bristles, comprising:

a handle having a front face;

a flexible neck extending from the handle, the neck being arcuate and forming a single 90° bend;

a brush head frame extending directly from the neck, the brush head frame being substantially U-shaped and defining a pair of substantially parallel prongs extending orthogonal to the front face of the handle, the brush head frame defining a recess between the prongs, wherein the handle, neck and brush head frame define a unitary, one-piece construction; and a bristle block having an elongated planar, imperforate base, a pair of edges, and a plurality of bristles extending from one side of the base, the bristle block being removably inserted in the recess defined by the brush head frame and retained solely by the prongs engaging the pair of edges, the bristle block being insertable in the recess in a first position in which the bristles extend laterally relative to the front face of the handle and in a second insertable position in which the bristles extend laterally relative to the front face of the handle 180° opposite the first position;

whereby a user inserts the bristle block in the first position for brushing a buccal side of selected teeth and in the second position for brushing a lingual side of the selected teeth.

2. The flexible, ergonomic toothbrush with replaceable bristles as set forth in claim 1, wherein the neck has a smaller cross-sectional area compared to said handle in order to flex relative to the handle.

3. The flexible, ergonomic toothbrush with replaceable bristles as set forth in claim 1, wherein the prongs of said brush head frame are resilient in order to resiliently grip the base of said bristle block.

4. The flexible, ergonomic toothbrush according to claim 1, wherein said prongs and the base of said bristle block form a friction fit to releasably hold said bristle block in the recess.

5. The flexible, ergonomic toothbrush according to claim 1, further comprising means for retaining said bristle block in the recess.

6. The flexible, ergonomic toothbrush according to claim 1, further comprising a plurality of teeth formed on opposing faces of said prongs for frictionally engaging said bristle block.

7. The flexible, ergonomic toothbrush according to claim 1, further comprising a plurality of ribs formed on opposing faces of said prongs for frictionally engaging said bristle block.

8. The flexible, ergonomic toothbrush according to claim 1, wherein said prongs have opposing faces having knurled surfaces for frictionally engaging said bristle block.

9. The flexible, ergonomic toothbrush according to claim 1, wherein said bristles comprise a first plurality of stiff bristles and a second plurality of soft, flexible bristles, the stiff bristles and the flexible bristles being intermixed.

10. The flexible, ergonomic toothbrush according to claim 1, wherein said bristles extend from the base of the bristle block at a plurality of angles, the bristles forming a fan-shaped profile when said bristle block is viewed from an end thereof.

* * * * *